United States Patent [19]

Morrissey

[11] Patent Number: 4,605,226

[45] Date of Patent: Aug. 12, 1986

[54] HEAD GUIDE AND BATTING HELMET

[76] Inventor: James Morrissey, 58 Mary St., Ashley, Pa. 18706

[21] Appl. No.: 643,784

[22] Filed: Aug. 23, 1984

[51] Int. Cl.[4] ..... A63B 61/00

[52] U.S. Cl. ..... 273/26 C; 273/29 A; 273/190 A

[58] Field of Search ..... 273/26 R, 26 C, 29 A, 273/190 R, 190 A, DIG. 17, 183 B; 2/10, 12, 15

[56] References Cited

U.S. PATENT DOCUMENTS

| | | | |
|---|---|---|---|
| 2,330,442 | 9/1943 | Nero | 273/190 A |
| 3,685,054 | 8/1972 | Raschke | 2/10 |
| 4,392,650 | 7/1983 | Hilton | 273/29 A |

FOREIGN PATENT DOCUMENTS

| | | | |
|---|---|---|---|
| 634093 | 5/1927 | France | 2/10 |
| 1096543 | 6/1955 | France | 2/10 |

*Primary Examiner*—Richard C. Pinkham
*Assistant Examiner*—T. Brown
*Attorney, Agent, or Firm*—Anthony J. Dixon

[57] ABSTRACT

A sports training device which includes an opaque shield releasably mounted on a protective helmet on the side opposite the source of a projectile travelling toward the user, in the case of baseball, or on the side facing the direction of intended flight of the ball to be struck whereby movement of the user's head out of the desired position results in the shielding of the eyes of the user from the projectile.

4 Claims, 5 Drawing Figures

HEAD GUIDE AND BATTING HELMET

BACKGROUND OF THE INVENTION

1. Field of the Invention

The present invention relates to sports in general and more particularly to games which require eye to hand coordination such as baseball, golf, tennis, field hockey and the like.

More particularly, the present invention relates primarily to baseball and to a device capable of assisting the participant in learning the proper head to shoulder transfer to enable the participant to generate his full potential in swinging a bat, club, racquet, hockey stick or the like.

When one determines to swing a bat or the like at a ball in a sport such as baseball, the theory of proper head to shoulder transfer and movement through the swing is critical in achieving solid contact with the ball and in transferring maximum force so as to hit the ball as far as possible. The same basic motion and head position applies to golf and tennis.

Accordingly, it has always been an aim of trainers, teachers and coaches of the game to develop proper head positioning and shoulder rotation so as to maximize a player's ability.

2. The Prior Art

In the past this has been accomplished in many sports by devices which restrain movement of the head such as is disclosed by Smallwood in U.S. Pat. No. 3,059,982—issued Oct. 23, 1962 and by Presta in U.S. Pat. No. 3,713,657 issued Jan. 30, 1973. Such devices would not be useful in faster action sports such as baseball and the like due to the possible danger of a quick, unanticipated movement as may occur when a batter must avoid a ball pitched at him.

Eyeglass type training devices have also been developed such as are disclosed by Palumbo in U.S. Pat. No. 3,264,002; however, such devices are inherently unsuitable for a sport with a fast moving projectile travelling in the direction of the user, such as a pitched ball. A projectile hitting such devices could seriously harm the user thereof.

Helmets have been used in sports such as baseball for many years and protective devices such as the helmet of C. Tatore et al as disclosed in U.S. Pat. No. 1,868,926 protect the head of the player but do nothing to assit him in mastering the sport.

A need is therefore unmet in this field. A need exists for a safe training device to train the eye without restraining the movement of the user and to protect the user while improving his proficiency level in the sport.

SUMMARY OF THE INVENTION

It is therefore an object of the present invention to provide a training device to be used in the sport of baseball, tennis, hockey and the like which enables the user to improve his hand-eye coordination and to maximize his physical power by maximizing the head to shoulder transfer so necessary in projectile contact sports.

It is a further object of the present invention to provide an apparatus which operates on the principle of obscuring ball vision unless the user's head is maintained in the proper position.

It is a further object of the present invention to provide a training device which can be combined with available head protection devices to achieve a combined protector-trainer to be used in sports utilizing a striking implement and a projectile for example, a bat and ball, racquet and ball or the like.

These and other objects of the present invention are obtainable by an apparatus which comprises an opaque body or shield mountable on the beak of a protective helmet on the side opposite the source of a projectile travelling toward the user whereby movement of the user's head away from the proper position results in the shielding of the eyes of the user from the projectile. Said shield is releasably moveable on the helmet so as to fly free if struck by the ball so as to minimize danger to the user.

The device of the present invention comprises a training device releasably mounted on a protective helmet which comprises:

a. a shield having a top flange and a main opaque body, b. a groove defined within said flange which is slidingly mounted on the edge of the beak of the protective helmet, and c. means for attaching said body to the helmet such as an elastic strap whereby the entire shield would fly free from the helmet upon impact by a projectile or ball.

Viewing the apparatus in a frontal fashion shows that it covers about one-half of the face; left side for a left handed player and right side for a right handed participant. The apparatus is releasably attached and is constructed of an opaque, durable, impact resistant, flexible, plastic material or the like.

The apparent advantages and other advantages of the invention will be more readily apparent upon review of the following drawings and description of the preferred embodiment.

THE PREFERRED EMBODIMENT

Figure 1:
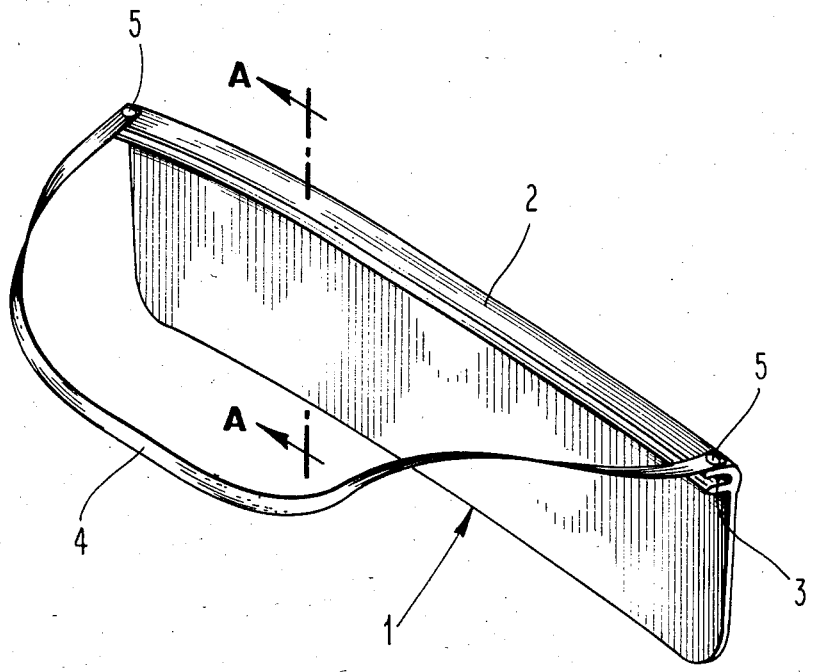
FIG. 1 is a perspective view of the device of the present invention not attached to a helmet.
Figure 2:
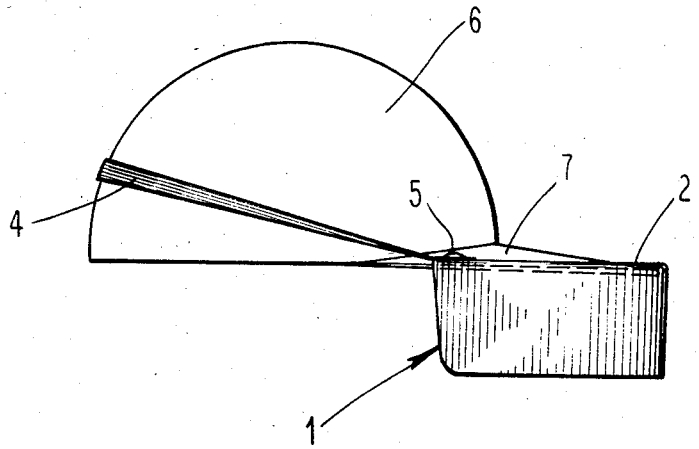
FIG. 2 is a perspective view of the present invention attached to a helmet.
Figure 3:
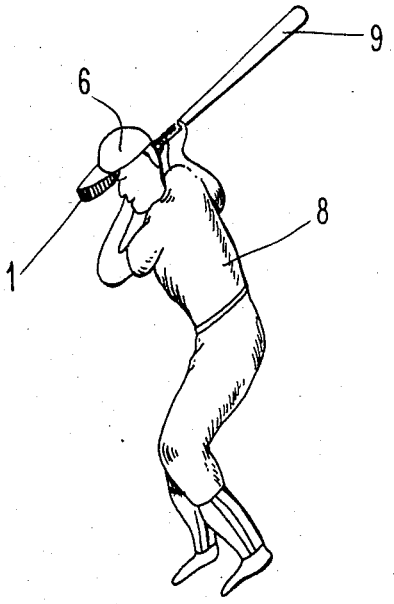
FIG. 3 is a perspective view of a user of the device wearing same.
Figure 5:
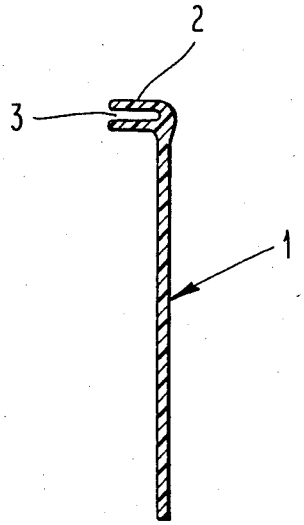
FIG. 5 is a view along lines A—A of FIG. 1.
Figure 4:
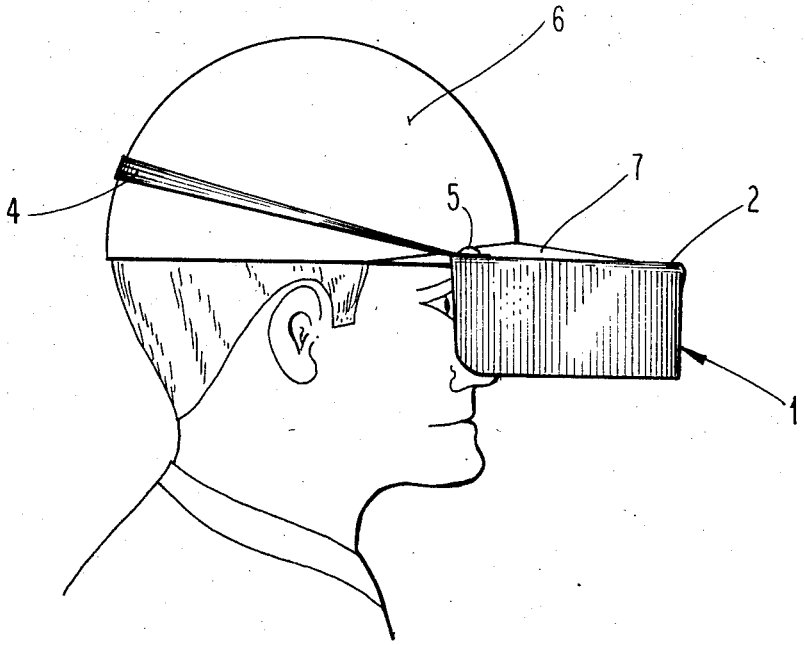
FIG. 4 is a perspective view of the device, helmet and user's head.

With reference to FIG. 1, the device of the present invention can be seen. The invention comprises the body, 1 which has an upper flange, 2 wherein groove, 3 is defined (See FIG. 5). This groove is accommodatingly larger than the thickness of the hat beak, 7 on helmet, 6 as shown in FIG. 4. In this way, the inventive guide is slidingly mounted on the helmet, 6 and retained thereon by strap, 4 which is attached at points, 5 front and back by rivets or the like. This strap circumferentially spans the helmet and holds the device in place yet it provides a releasable attachment which will release if the device is struck by a ball. An elastic strap is preferred; however, it is not an essential feature.

The body, 1 extends to mid check if being used in golf or tennis.

When being utilized, the apparatus is mounted to the helmet and covers about one-half of the face of the user. The apparatus is correctly positioned where the user can see, in the case of baseball, the pitcher, first baseman or third baseman by a mere eye shift without shifting the head. When a pitched ball approaches the user, correct head position will keep the ball in sight. If the user leans or pulls his head out of position, the device will then be in his line of sight to the approaching ball. In this way the user will keep his eye on the ball and his head in the proper position through the swing and ultimate impact.

The device will only come into play when the user has already decided to swing at the ball. If the ball is moving toward the user, his vision is not blocked so as to allow the user to move from the pathway of the ball which might strike him.

It should be noted that should the device be struck by an oncoming projectile in the lower half of body, 1 the pliable plastic will easily bend to allow the ball to pass.

If the device is struck in the upper portion of body, 1 the plastic band, 4 will allow the device to move upwards thus allowing the projectile to pass without harm to the user. A projectile, however, will only strike the device when the user is out of batting position, that is, falling away or down from a pitched ball.

The device therefore provides training and protection.

It will be understood that such a device can be designed in many ways and attached to the helmet in a variety of fashions; however, these modifications are possible without departing from the scope of the present invention and attached claims.

I claim as my invention:

1. A baseball training device in combination with a protective baseball batting helmet having a beak comprising a. a shield comprised of a elongated top flange and a main opaque body, said shield having adjustment means and a length whereby said shield may be adjusted on said helmet beak to cover only the left half of the face of a left handed batter and only the right half of the face of a right handed batter, b. said adjustment means being a groove defined along the length of said flange, of a width accommodatingly larger than the thickness of the beak, and slidingly mounted thereon;

c. means for releasably attaching said shield to said protective batting helmet.

2. The device of claim 1 wherein said main opaque body is of sufficient width to cover the upper one-half of a user's face.

3. The device of claim 1 wherin said means for attaching the shield comprises an elastic strap stretched circumferentially around the helmet.

4. The device of claim 3 wherein said shield is further constructed of, flexible, impact resistant plastic.

* * * * *